US009644395B2

(12) United States Patent
Strand

(10) Patent No.: US 9,644,395 B2
(45) Date of Patent: May 9, 2017

(54) DEADBOLT KNOB SECURITY DEVICE

(71) Applicant: Danny L. Strand, Seattle, WA (US)

(72) Inventor: Danny L. Strand, Seattle, WA (US)

( * ) Notice: Subject to any disclaimer, the term of this patent is extended or adjusted under 35 U.S.C. 154(b) by 0 days.

(21) Appl. No.: 14/080,841

(22) Filed: Nov. 15, 2013

(65) Prior Publication Data

US 2014/0165670 A1 Jun. 19, 2014

Related U.S. Application Data

(60) Provisional application No. 61/738,003, filed on Dec. 17, 2012.

(51) Int. Cl.
*E05B 13/00* (2006.01)
*E05C 19/18* (2006.01)
*E05B 13/04* (2006.01)

(52) U.S. Cl.
CPC ..... *E05B 13/002* (2013.01); *E05B 13/04* (2013.01); *E05C 19/18* (2013.01); *Y10T 70/5199* (2015.04)

(58) Field of Classification Search
CPC .... E05B 13/001; E05B 13/002; E05B 13/007; E05B 13/04; E05B 17/20; E05B 17/2084; E05B 17/2088; E05B 17/2092; E05C 19/18; Y10T 70/5199
USPC ..... 70/416, 450, 452, 211, 429, 430; 292/258, 288, 339
See application file for complete search history.

(56) References Cited

U.S. PATENT DOCUMENTS 2,515,364 A * 7/1950 Weaver ..... E05B 13/002 292/288
3,585,827 A * 6/1971 Dominguez ..... E05B 13/04 70/416
4,279,137 A * 7/1981 Cook ..... E05B 13/04 70/416
4,426,861 A * 1/1984 Chillis ..... B62L 3/06 70/203
4,827,745 A * 5/1989 Baugh ..... E05B 13/002 70/211
5,035,128 A * 7/1991 Ridgway ..... E05B 13/04 70/211

(Continued)

OTHER PUBLICATIONS

"Uniaxial." American Heritage® Dictionary of the English Language, Fifth Edition. 2011. Houghton Mifflin Harcourt Publishing Company Jun. 2, 2016http://www.thefreedictionary.com/uniaxial.*

*Primary Examiner* — Christopher Boswell
*Assistant Examiner* — Amanda L Miller
(74) *Attorney, Agent, or Firm* — Global Intellectual Property Agency, LLC; Daniel Boudwin

(57) ABSTRACT

A deadbolt knob security device is provided, whereby rotation of the deadbolt knob is linked to motion of an intermediate member assembly secured to a door element positioned next to the deadbolt knob. The device comprises several embodiments for surrounding the exposed interior knob of a deadbolt, as well as several embodiments for the adjustable intermediate member assembly between the deadbolt knob attachment and door knob attachment, wherein a door knob attachment member is provided in a U-shaped configuration to surround a door knob stem. Adjustability for accommodating doors of different design and specification is provided, while an electronic security monitor is accommodated along the device to monitor for tampering of the device while installed.

13 Claims, 9 Drawing Sheets

(56) References Cited

U.S. PATENT DOCUMENTS

| | | | | |
|---|---|---|---|---|
| 5,218,341 | A * | 6/1993 | Marik | G08B 13/08 292/339 |
| 6,182,485 | B1 * | 2/2001 | Moore | E05B 13/002 292/258 |
| 6,301,941 | B1 * | 10/2001 | Nicholsfigueiredo | E05B 13/04 292/150 |
| 6,993,944 | B2 * | 2/2006 | Hicks | E05B 13/04 70/211 |
| 7,770,420 | B2 * | 8/2010 | Carr | E05C 19/003 292/259 R |
| 2012/0222459 | A1 * | 9/2012 | Glazar | E05B 13/04 70/91 |

* cited by examiner

DEADBOLT KNOB SECURITY DEVICE

CROSS REFERENCE TO RELATED APPLICATION

This application claims the benefit of U.S. Provisional Application No. 61/738,003 filed on Dec. 17, 2012, entitled "Doorclub." The above identified patent application is herein incorporated by reference in its entirety to provide continuity of disclosure.

BACKGROUND OF THE INVENTION

Field of the Invention

The present invention relates to door security devices and attachable locking assemblies. More specifically, the present invention pertains to a new and novel deadbolt security device for preventing unauthorized movement of the knob of a deadbolt latch from the interior side of a door.

Security of a residence is vitally important for most homeowners and apartment dwellers. The ability to protect against unauthorized access onto one's property allows the property dweller to feel safe while inhabiting the same or when leaving the residence unoccupied for periods of time. Proper security offers a sense of peace and a reduced level of anxiety with respect to fear of intruders or home invasions. Securing one's premises encompasses protecting one's personal property, protecting one's loved ones from danger, and further involves protecting the property dweller's privacy while in the residence, where all of these items can be compromised without suitable barriers to entry.

Security of a residence has many facets with respect to preventing unauthorized access by intruders or uninvited guests. These include physical barriers, such as secure windows and doors, as well as electronic security systems, such as open space motion sensors, increased lighting on the premises, entryway monitors, and secure electronic access. The present invention pertains to a new and novel means of bolstering existing physical barriers at an entryway, where typically a door knob and deadbolt is provided for locking an entryway door and from the inside of the residence.

Most entryway doors include a deadbolt assembly in combination with a door knob. The door knob can further be lockable, and provides the means of latching the door closed with minimal effort. The additional deadbolt assembly includes a post that is slidably engaged with the door frame, improving the security of the door and preventing the door from easily being pushed inward. However, most deadbolts include a turn knob on the interior side thereof. The turn knob provides a quick means of disengaging the deadbolt in case of an emergency, where a double-sided key lock would otherwise be unsafe in the event of a fire and may not be suitable given the building code. While offering a quick means to disengage the deadbolt, the turn knob is less secure than the alternatives, and is prone to being tampered with.

The present invention pertains to a deadbolt latch security member that is adapted to connect to the knob of the latch and secure the same to a door knob positioned therebelow. The device secures to the knob member and prevents rotation thereof, wherein rotation is countered by the device bearing against the door knob and resisting motion. Several embodiments are provided, including a means of monitoring motion of the device while engaged. Monitoring motion of the device can alert the dwelling occupants of a possible tampering situation, thereby providing an active warning system along with the increased physical security provided by the device. Overall, the device is intended to improve the physical security of dwellings at major entryways, wherein the device is attached from the inside of a knob-controlled deadbolt.

Description of the Prior Art

Devices have been disclosed in the prior art that relate to deadbolt security devices. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

Devices exist in the art that relate to deadbolt latch security devices, whereby a physical device is placed in connection with a deadbolt knob to prevent its rotation without authorization from one in the dwelling. These devices have familiar design elements for preventing rotation of the knob, whereby the knob rotation is prevented by abutting a member against the underlying door knob. These devices assist the deadbolt and prevent ready turning of the knob, even when a key is utilized from the exterior of the door. The present invention, however, discloses a new and novel deadbolt knob device that allows for superior fitment on existing knobs, superior security over the device while deployed, and superior adjustability of the device over existing devices in the art.

One such device in the art is U.S. Pat. No. 6,993,944 to Hicks, which discloses a dead bolt lock that is removably engageable onto a deadbolt knob and includes a pair of legs that extend downward therefrom to surround a door knob below the deadbolt. The device includes a housing for accepting the deadbolt knob therein, the housing includes an opening to accept a rotatable front plate therein. The front plate rotates with respect to the housing before being secured thereto, wherein the knob is secured by the front plate that is rotatably adjusted to match the angle of the knob. While disclosing a device with the same intent as the present invention, the device of Hicks discloses a different structure than that of the present invention, which contemplates adjustability using different means and a knob connection of diverging structure.

Another device is U.S. Pat. No. 4,279,137 to Cook, which discloses another such security device for preventing a deadbolt knob from turning, wherein a rigid, planar member is provided. The rigid member includes a vertical aperture for accepting the deadbolt knob therethrough, while a pair of spaced apart legs that straddle the shaft of the door knob below the deadbolt assembly. The Cook device, while simple and novel in its own right, fails to provide a means to adjust its connection with the deadbolt knob, thereby limiting its use to those deadbolts that have a vertical terminal orientation when in a locked position.

U.S. Pat. No. 5,035,128 to Ridgway discloses a device for preventing rotation of the deadbolt knob that comprises a V-shaped element having an interior angle adapted to receiving the deadbolt knob therein, along with a base element and an extension means. Similar to the Cook device, the Ridgway device utilizes a defined shape to secure over the deadbolt knob. While some means of adapting the device are provided, the Ridgway device is significantly divergent in structural elements from all embodiments of the present invention.

Finally, U.S. Pat. No. 3,585,827 to Dominguez discloses yet another security locking device, wherein a spring-biased knob retention member surrounds the knob of a deadbolt lock while a shaft abuts against a door knob shaft to prevent rotational movement of the knob. An adjustment means is provided to adjust the angle between the knob retention member and the shaft, while the shaft may be straight or slightly curved. Overall, the Dominguez device discloses a device for a similar purpose but with diverging structure with regard to the present invention.

The present invention is a new and novel deadbolt knob security device that prevents unauthorized turning of the knob and thus unauthorized retraction of the deadbolt latch. The device comprises several embodiments for securing the rotation of the deadbolt knob to a member that bears against the door knob adjacent to the deadbolt assembly. The embodiments provide structures that accommodate different door knob and deadbolt geometries and positions, while an electronic monitoring means is provided for detecting motion of the device while deployed. The motion energizes an audible alarm that alerts individuals within the dwelling that the device is being tampered with or that someone is attempting to turn the deadbolt knob.

It is submitted that the present invention is substantially divergent in design elements from the prior art, and consequently it is clear that there is a need in the art for an improvement to existing deadbolt security devices. In this regard the instant invention substantially fulfills these needs.

SUMMARY OF THE INVENTION

In view of the foregoing disadvantages inherent in the known types of deadbolt knob securing devices now present in the prior art, the present invention provides a new deadbolt knob security device that can be utilized for providing convenience for the user when preventing rotation of a deadbolt knob by linking its rotation to a member that bears against an adjacent door knob.

It is therefore an object of the present invention to provide a new and improved deadbolt knob security device that has all of the advantages of the prior art and none of the disadvantages.

It is another object of the present invention to provide a deadbolt knob security device that includes a deadbolt knob attachment head, an elongated member extending therefrom, and a door knob attachment member at the base of the elongated member, where several embodiments of the elements are herein provided.

Another object of the present invention is to provide a deadbolt knob security device that utilizes a U-shaped door knob attachment member to secure the rotation of the deadbolt knob to the stem of the door knob therebelow.

Yet another object of the present invention is to provide a deadbolt knob security device that includes several means of adjusting the length and orientation of the elongated member, wherein the locked position of the deadbolt knob is maintained and rotation thereof causes the device to bear against the door knob to prevent free rotation.

Another object of the present invention is to provide a deadbolt knob security device that accommodates different door geometries and different deadbolt knob orientations when deployed, wherein the device can be adjusted to fit any door configuration and secure the same in a locked state.

Another object of the present invention is to provide a deadbolt knob security device that includes a location for optionally attaching a motion sensor to the elongated member, wherein attempted rotation of the deadbolt knob or movement of the device energizes an audible alert for users inside the dwelling.

A final object of the present invention is to provide a deadbolt knob security device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
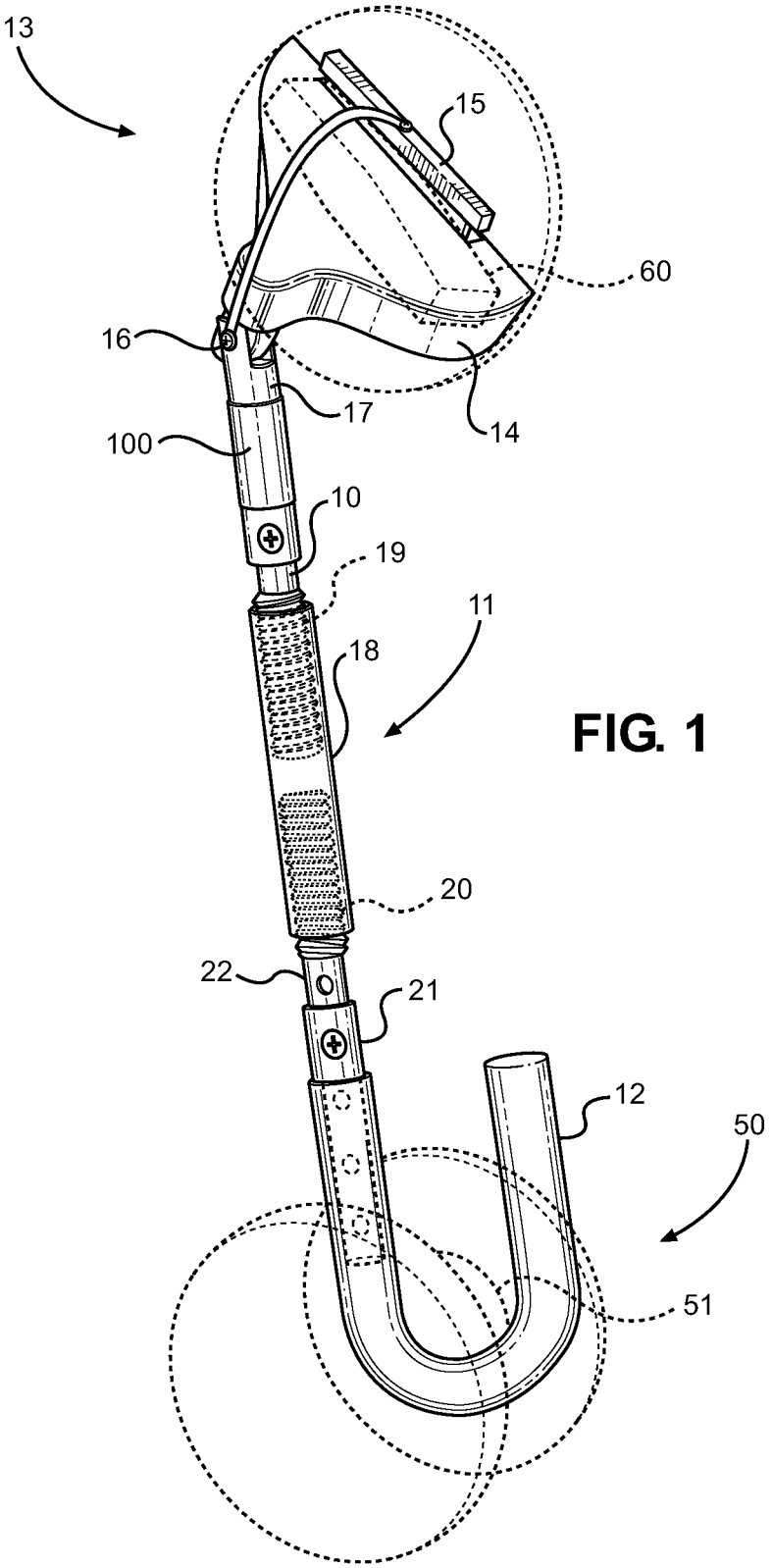
FIG. 1 shows a view of an exemplary embodiment of the present invention.

Reference is made herein to the attached drawings. Like reference numerals are used throughout the drawings to depict like or similar elements of the deadbolt knob security device. For the purposes of presenting a brief and clear description of the present invention, the preferred embodiment will be discussed as used for preventing unauthorized rotation of a deadbolt knob when locked and providing a means to monitor the same. The figures are intended for representative purposes only and should not be considered to be limiting in any respect.

Referring now to FIG. 1, there is shown a perspective view of an exemplary embodiment of the present invention in a working state, secured to a deadbolt knob 60 and linking the knob 60 to a door element adjacent thereto, such as the stem 51 of a door knob 50 or the body of a door handle. The device provides a means to secure a deadbolt knob 60 and prevent rotation thereof by transferring rotational motion of the knob 60 to an intermediate member assembly 11 whose base end bears against the adjacent door element and prevents the otherwise free rotation of the deadbolt knob 60.

This ensures the deadbolt knob 60 remains in a locked position, whereby a key cannot disengage the deadbolt from the exterior side of the door, and free rotation of the knob is inhibited from the inside.

The device comprises a first deadbolt knob attachment head 13 that is pivotably attached 16 to the upper of an elongated intermediate member assembly 11, which is adapted to extend toward a door knob 50 positioned next to the deadbolt knob 60. The base of the intermediate member assembly 11 is a curved, preferably U-shaped door knob attachment member 12. This member 12 secures around the stem 51 of a door knob 50 and acts as a bearing member, whereby rotation of the deadbolt knob 60 is transferred to the intermediate member assembly 11 and to the door knob attachment member 12 therebelow, which bears against the door knob 50 to prevent disengagement of the deadbolt.

Figure 3:
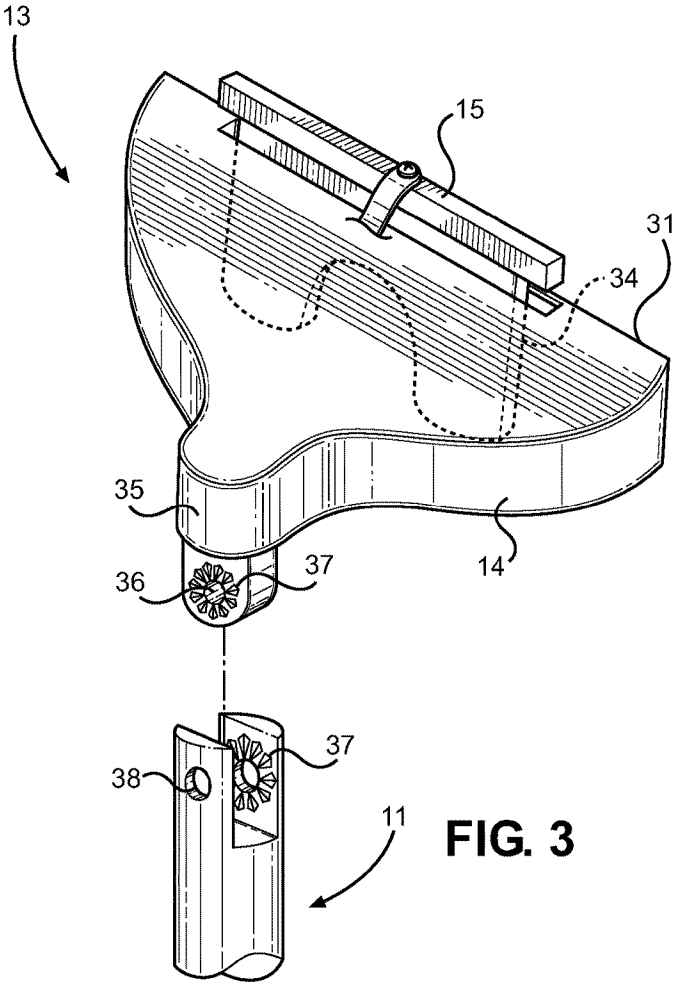
FIG. 3 shows a rear perspective view of the exemplary embodiment of the deadbolt knob attachment head, along with its rotatable connection to the elongated member.
Figure 2:
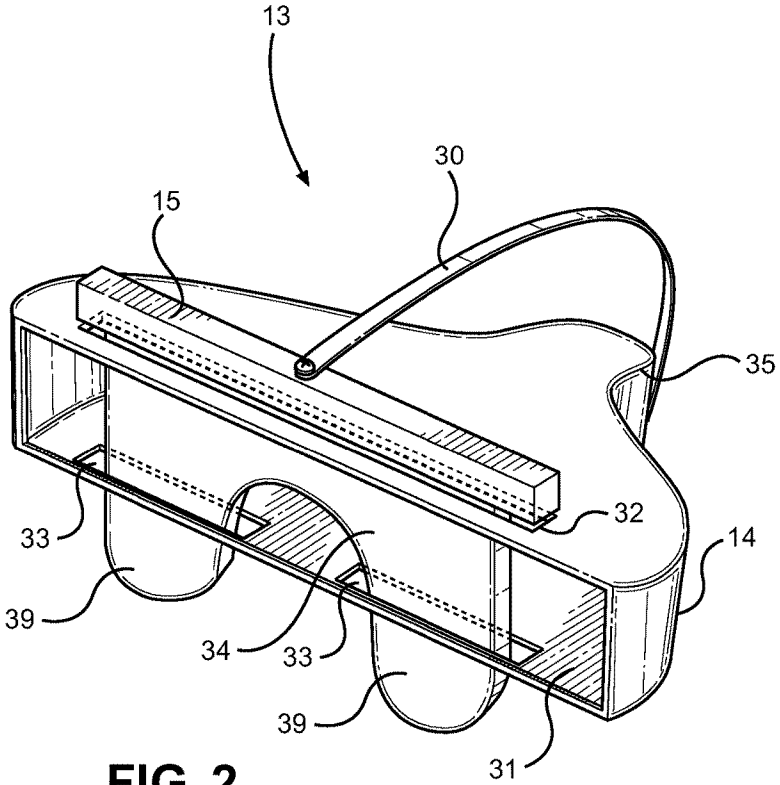
FIG. 2 shows a frontal perspective view of the exemplary embodiment of the deadbolt knob attachment head.

In its exemplary embodiment, as shown in FIGS. 1 through 3, the present invention comprises a deadbolt knob attachment head 13 having an enlarged housing 14 to surround the exterior of the deadbolt knob 60. The housing 14 is preferably pivotably attached 16 to the intermediate member to allow the housing 14 to orient with respect to the knob 60 and restrain its motion when the knob 60 is in its locked orientation. Since this orientation can be different from different deadbolt configurations, a pivoting head 13 allows one to accommodate the locked angle.

As shown in FIGS. 1 through 3, the housing 14 of the deadbolt knob attachment head 13 comprises an open interior and a forward aperture 31 to accept the deadbolt knob 60 therein and therethrough, respectively. Once the knob 60 is positioned in the housing 14, a retainer clip 15 is placed through an engagement slot 32 in the housing along the forward aperture 31. The clip 15 includes a curved, U-shaped surface 34 that is adapted to surround the knob 60 at its base. The ends 39 of the surface 34 engage corresponding slots 33 within the housing opposite the clip engagement slot 32. Once engaged, the clip 15 prevents the housing 14 from being pulled away from the knob 60 without first removing the retainer clip 15. The clip 15 is preferably tethered 30 to the housing to prevent the clip 15 from being dropped or misplaced between uses.

Referring now to FIG. 3, there is shown a rear view of the exemplary embodiment of the deadbolt knob attachment head 13 and an exploded view of the pivotable connection between the attachment head housing 14 and the intermediate member assembly 11. In a preferred connection, the rear portion 35 of the housing 14 comprises one half of a clevis fitting, whereby an aperture 36 is provided for aligning with the aperture 38 of a corresponding clevis fitting half at the end of the intermediate member assembly 11. A fastener is placed through the aligned apertures 36, 38, whereby the clevis fitting provides a pivotable connection between the intermediate member assembly 11 and the housing 14. To prevent free rotation at this joint when deployed, it is preferred that upstanding ridges 37 be positioned at the interface surfaces of the clevis to ensuring a non-slip connection. The ridges prevent small-angle rotation of the housing 14 with respect to the intermediate member assembly 11 to further secure the assembly in a locked and stable configuration when applied to a deadbolt knob.

Referring back to FIG. 1, the intermediate member assembly 11 is shown having several adjustment means. It is preferred that this elongated member have length adjustability, whereby its length can be changed to accommodate the separation between the door knob 50 and the deadbolt knob 60, along with accommodating the orientation of the deadbolt knob attachment head 13 when thereconnected. In one embodiment, the intermediate member assembly 11 comprises an elongated shank 18 having a first and second tapped and threaded end. These ends accept the threaded ends 19, 20 of an upper intermediate member 17 and a lower intermediate member 22, respectively.

The lower intermediate member 22 may comprise the upper portion 21 of the U-shaped door knob attachment member 12, or attached (as shown in FIG. 1) via a separate threaded member 22 extending therefrom. The upper intermediate member 17 may also be directly threaded to the elongated shank 18 or may be connected to an extendable threaded member 10. Both threaded members 22, 10 are fastened to their corresponding intermediate members and threadably attached to the central, elongated shank 18. The threads at the ends of each shank are opposing in thread direction, whereby rotation of the shank 18 in one direction forces the threaded members 10, 22 toward or away from the shank 18 in a synchronous fashion. Thereby, the shank 18 permits a user to rotate the same to extend the intermediate member assembly 11 or retract the assembly 11 for a secure fitment on the door.

Figure 4:
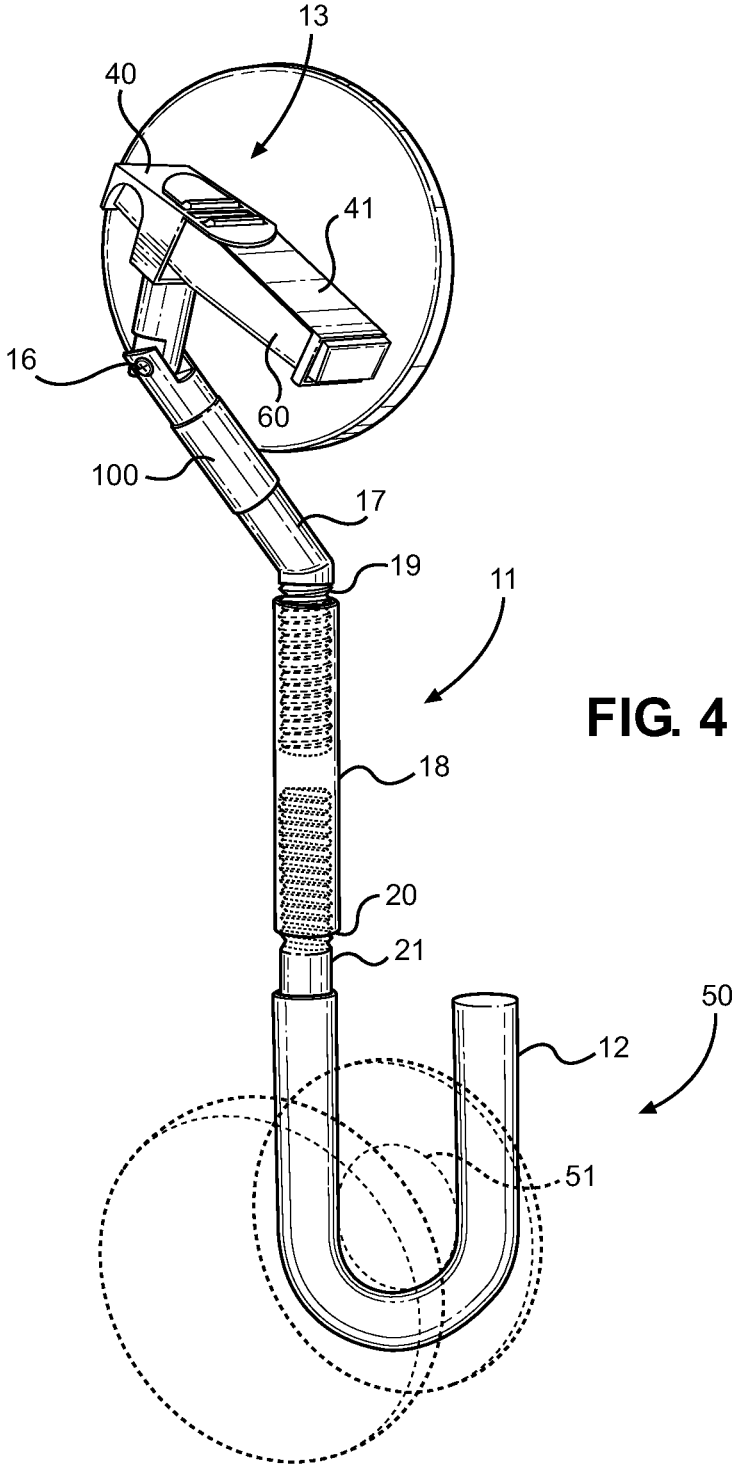
FIG. 4 shows a view of an embodiment of the present invention.

Referring now to FIG. 4, there is shown a view of an embodiment of the deadbolt knob security device. This embodiment contemplates a similar configuration as FIG. 1, wherein the deadbolt knob attachment head 13 comprises a deadbolt end sleeve 40 and a corresponding retainer sleeve 41 that is adapted to conform to a largely rectangular deadbolt knob 60. The deadbolt end sleeve 40 is pivotably attached 16 to the intermediate member assembly 11, while the door knob attachment member 12 comprises a U-shaped member. The intermediate member assembly 11 may comprise the central shank 18 that is threadably connected to an upper 17 and lower 21 intermediate member, which allows for length adjustment of the device when deployed. The upper 17 or lower 21 intermediate member may further be angled or bent to provide an offset for the deadbolt knob attachment head 13.

Figure 5:
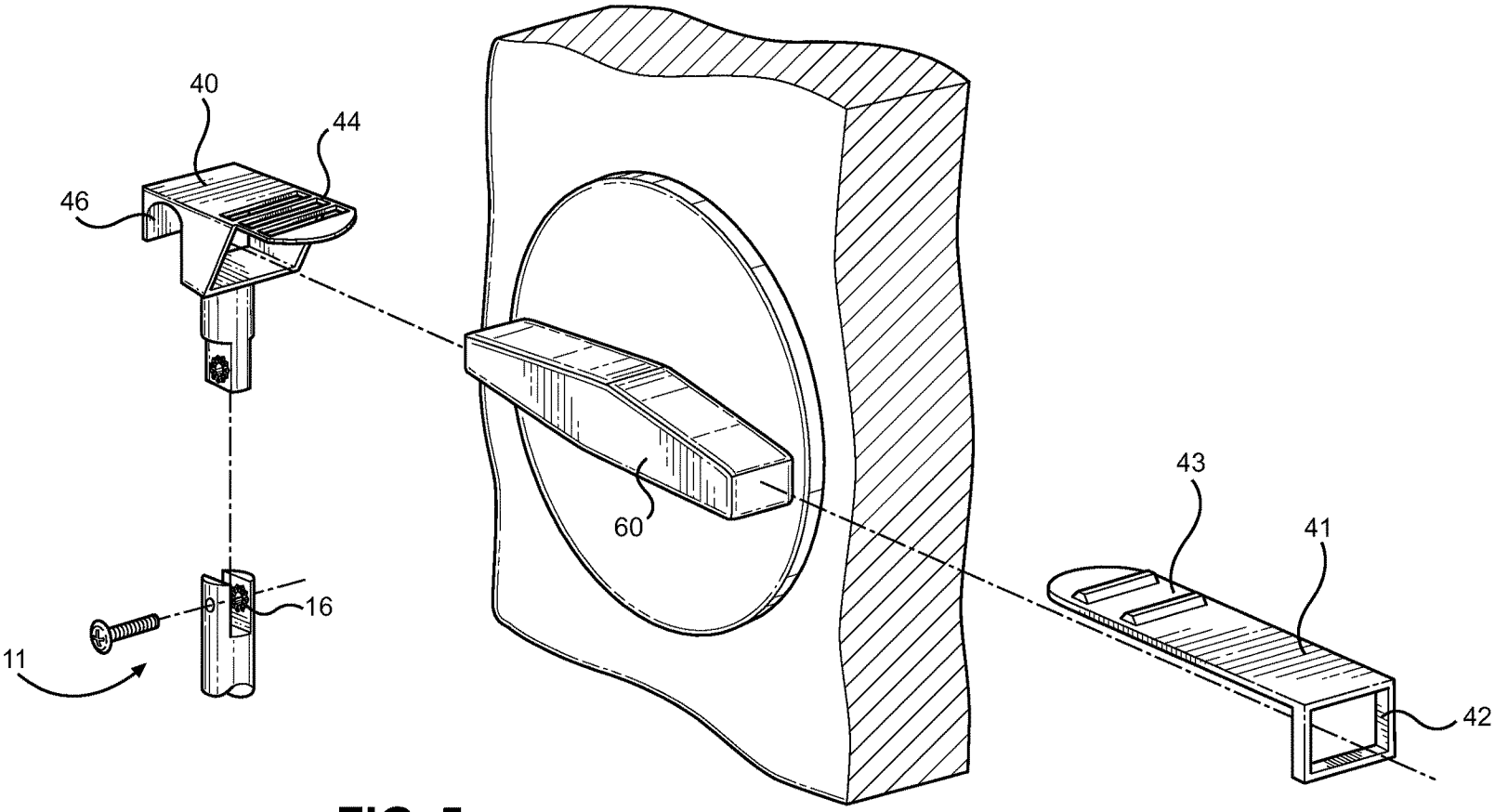
FIG. 5 shows a view of an embodiment of the deadbolt knob attachment head.

Referring now to FIG. 5, the deadbolt end sleeve 40 embodiment of the deadbolt knob attachment head is shown in an exploded view, along with the corresponding the retainer element 41. The sleeve 40 comprises an open interior section having an open end and a closed end 46, wherein the outer body profile of the sleeve is adapted to conform to the shape of the deadbolt 60 while the closed end abuts thereagainst. The upper surface of the sleeve 40 includes a plurality of apertures 44 that are adapted to accept the retainer element 41 therethrough and at least one of the raised ridges 43 of the retainer element 41. The ridges 43 are disposed on the upper surface of the retainer element 41 and engage the apertures 44 of the deadbolt end sleeve 40 once the element 41 is placed therethrough to prevent pull-through separation of the sleeve 40 from the deadbolt knob 60 as the element 41 is supported by the knob opposite end. The distal end of the retainer element 41 comprises an open member 42 that accepts through one end of the deadbolt knob 60 therein such that the sleeve 40 and retainer element 60 sandwich the deadbolt knob 60. Once positioned thereon, the intermediate member assembly 11 and its pivotable attachment 60 can be utilized to secure the deadbolt knob 60 in a locked position.

Figure 7:
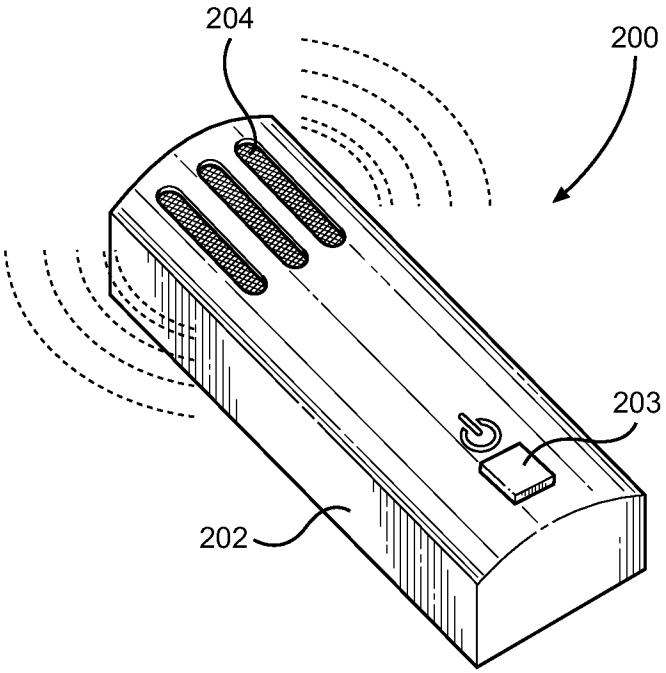
FIG. 7 shows a front view of the electronic monitoring means.
Figure 6:
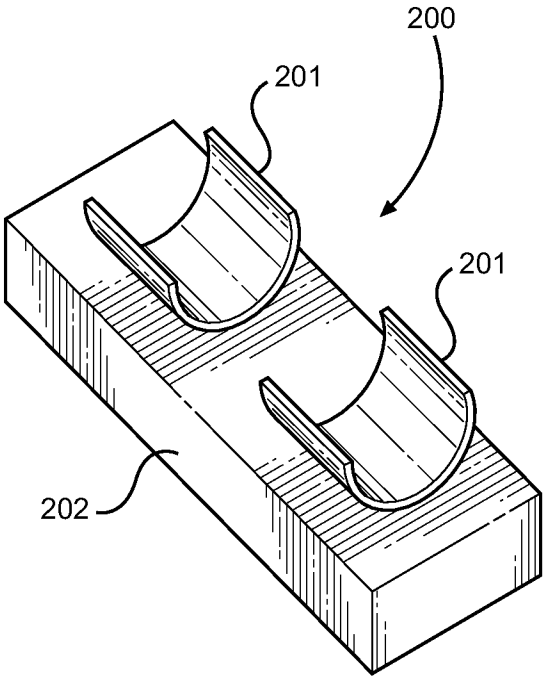
FIG. 6 shows a rear view of the electronic monitoring means.

Referring now to FIGS. 6 and 7, there is shown a front and rear perspective view of the electronic monitoring means 200 of the present invention. The electronic monitoring means 300 comprises a battery-powered motion sensor that is attachable to the intermediate member assembly of the present invention. At least one attachment clip 201 is disposed on the base of the monitoring means housing 202, wherein the housing 202 includes an interior volume to house a battery and electric circuit for monitoring motion of the housing 202 and for energizing an audible alert. The alert is produced through a speaker 204 and provides a user with notice that the deadbolt knob security device of the present invention is being tampered with, or that the deadbolt latch is being moved (potentially by a user with a key or with a lock pick). The device is an electrical unit placed on the deadbolt knob security device for improved safety of interior dwellers. A power button 203 controls operation and flow of current from the battery to the electric circuit controlling the device operation. The device may be removably attached to a sleeve 100 (see FIGS. 1 and 4), while the battery may be replaced after a period of use.

Figure 8:
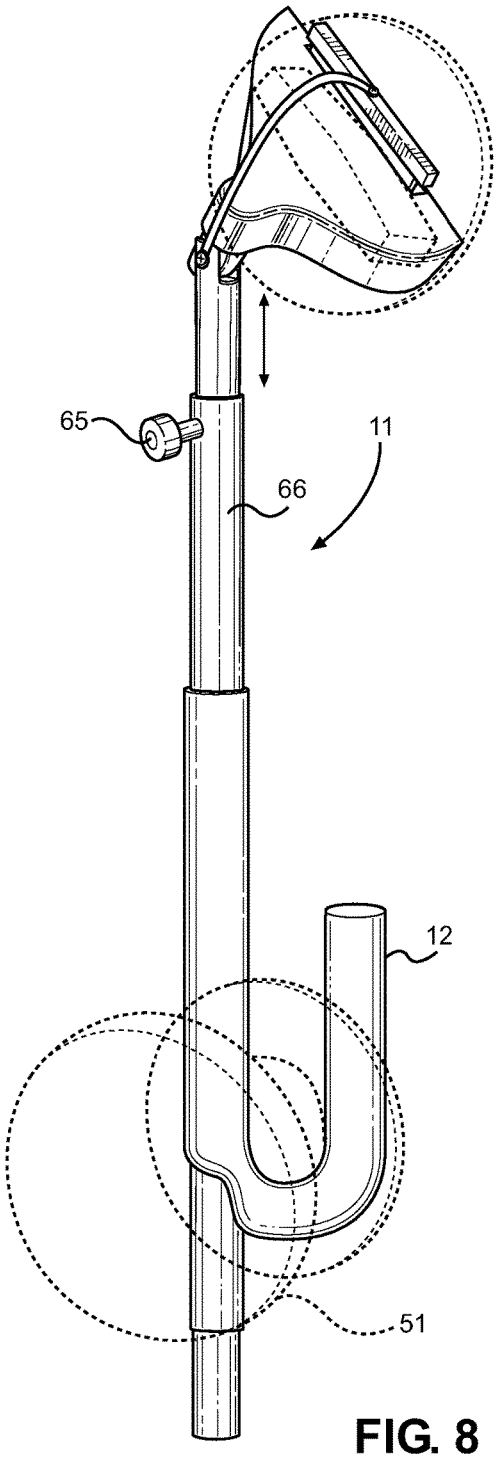
FIG. 8 shows a view of yet another embodiment of the present invention.

Referring now to FIG. 8, there is shown yet another embodiment of the deadbolt knob security device of the present invention. This embodiment contemplates a slidably adjustable intermediate member assembly 11, wherein a lower intermediate member 66 accepts through its interior an upper intermediate member 17 in a telescoping fashion, wherein the upper intermediate member 17 is lockably secured using a set screw 65. The deadbolt knob attachment head 13 may comprises the deadbolt knob housing (see FIG. 1), or alternatively may comprise a deadbolt knob sleeve 40 and retainer element. The deadbolt knob attachment head 13 is pivotably attached to the intermediate member assembly 11, while the lower door knob attachment member 12 comprises a U-shaped member extending therefrom.

Figure 9:
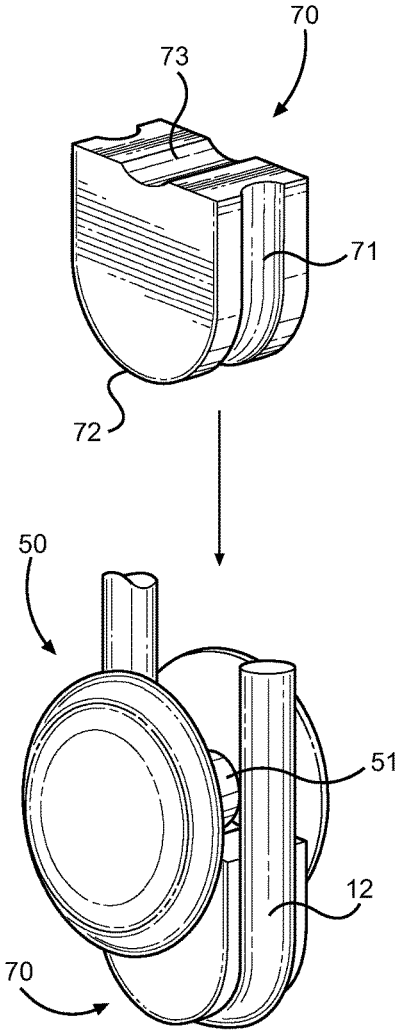
FIG. 9 shows a view of the door knob attachment member being utilized in conjunction with a door knob stem engaging member.

Referring now to FIG. 9, there is shown a view of a door knob attachment member 12 being utilized in conjunction with a door knob stem engaging member 70. The stem engaging member 70 comprises a molded block having a rounded construction that is adapted to support the door knob attachment member 12 along its exterior surface 71, while bearing against the stem 51 of a door knob 50 along its interior surface 73. The interior 73 and exterior 71 surfaces are grooved to accommodate the stem 51 and attachment member 12 structures. This member 70 is useful for conforming the device to a door knob of unique structure, and for providing an offset between the attachment member 12 and the door knob 50, if required. Its construction preferably comprises a flat first end and a rounded second end 72.

Figure 10:
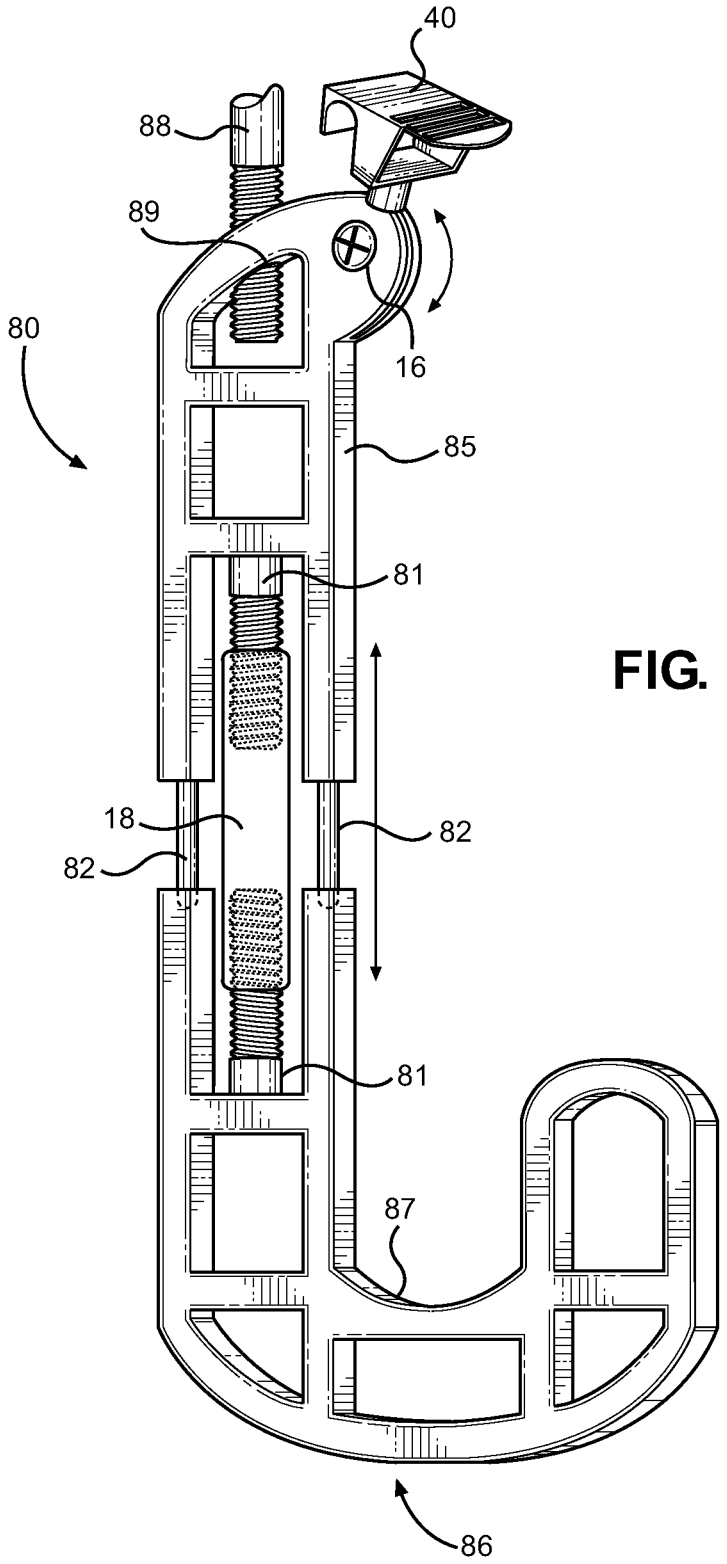
FIG. 10 shows a view of another embodiment of the present invention.

Referring now to FIG. 10, there is shown a view of another embodiment of the present invention. In this embodiment, the device is comprised of an upper 80 and lower 86 frame that are connected via central intermediate members 81 that control the separation of the upper 80 and lower 86 frames and allow for adjustability of the device when deployed. The lower frame 86 comprises a U-shaped frame having an open, lattice-style construction and a shelf region 87 adapted to bear against a door knob. The upper frame 80 supports a deadbolt knob attachment head that is pivotably supported 16. Between the frames is a first and second threaded intermediate member 81 that threadably connects to a threaded shank 18. As with the exemplary embodiment, rotation of the shank 18 causes the members 81 to move closer or spread apart, and thus controls the separation between the frames 80, 86. A first and second dowel 82 adds stability to the frames as they are separated and prevent binding of the shank 18 threads.

Along the upper portion of the upper frame 80 is a threaded aperture that can be utilized to secure another intermediate member 88, wherein a deadbolt knob attachment head can be positioned thereon and far above the upper extent of the upper frame 80. The deadbolt knob attachment head may be the deadbolt knob housing or the knob sleeve 40, as previously defined.

Figure 11:
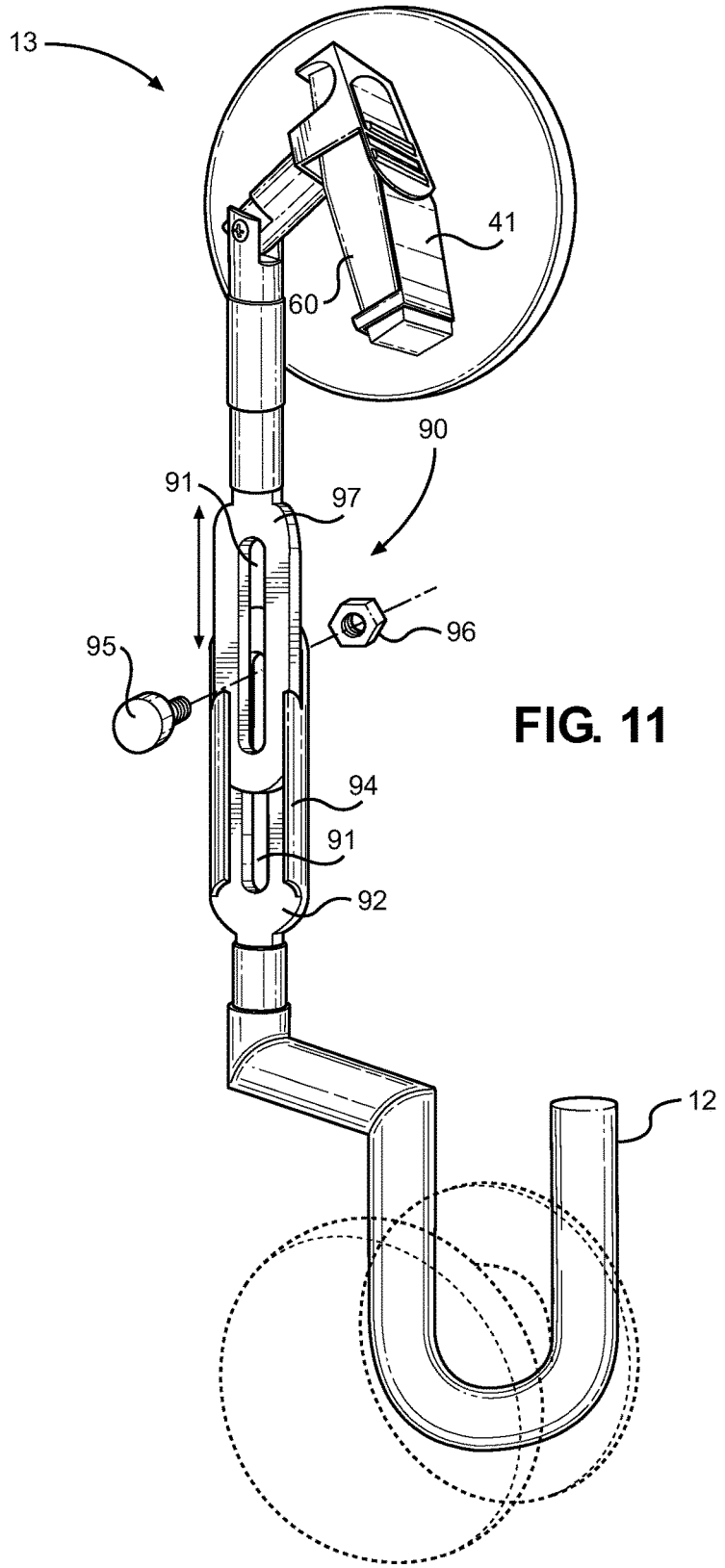
FIG. 11 shows another embodiment of the present invention.

Referring now to FIG. 11, there is shown yet another embodiment of the present invention as it relates to length adjustability of the device. In this embodiment, a sliding sleeve 90 is provided to adjust the length of the intermediate member assembly and thus the gap between the upper deadbolt knob attachment head 13 and the door knob attachment member 12. The sleeve comprises a first 92 and second 97 elongated channel member in slidable engagement with one another. Each of the channel members includes an elongated slot 91, while the members are sandwiched together via a lip 94 along the first member 92. A fastener 95 is utilized to clamp the sliding members together, while the lip 94 prevents rotation about the single fastener clamping location. The relative position of the members controls the overall separation between the door knob attachment member 12 and the deadbolt knob attachment head 13.

Figure 12:
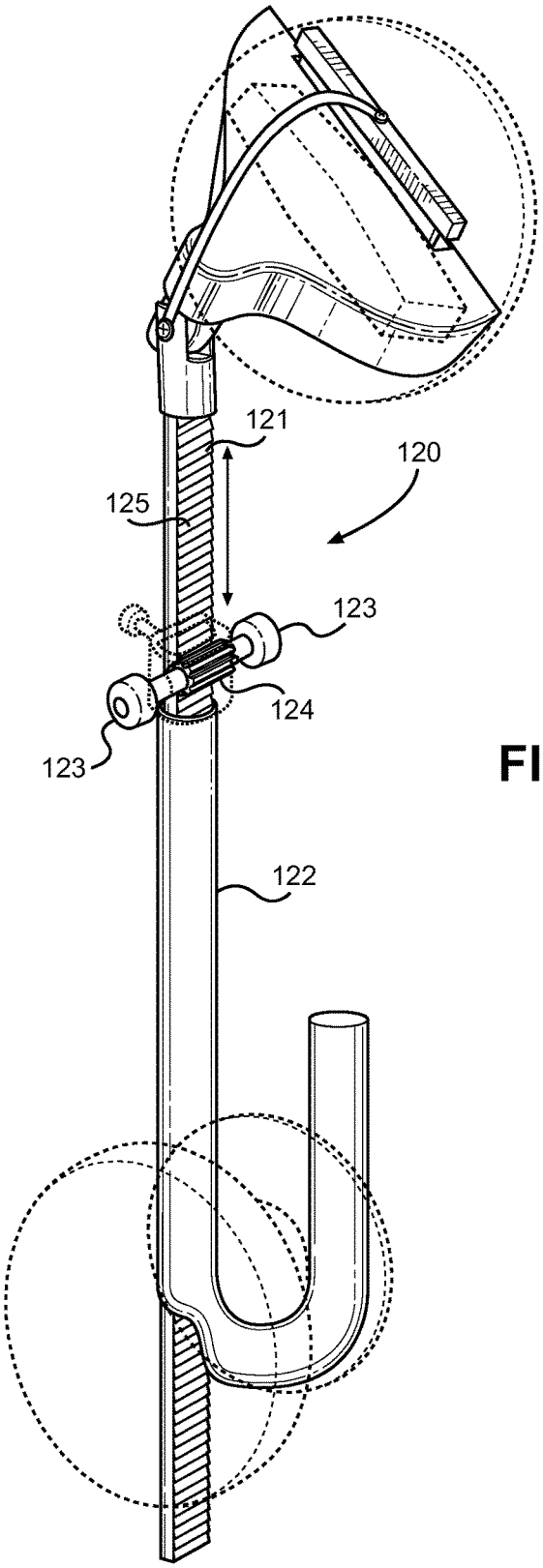
FIG. 12 shows a final embodiment of the adjustable intermediate member assembly.

Referring finally to FIG. 12, the intermediate member assembly length is controlled by an adjustment gear 120 that allows the user to slidably adjust an upper 121 and lower 122 intermediate member and thus the span between the door knob attachment member and the deadbolt knob attachment head. The gear is turned by way of an adjustment handle 123, whereby the gear pinion 124 of the lower member 122 controls linear motion of a gear rack 125, which is positioned along the upper member 121. The rack 125 slides upwards and downwards and changes the overall length of the device, allowing the user to tighten or loosen the connection between the deadbolt knob and door knob when deployed.

The present invention describes a security device for a deadbolt assembly adjacent to a door knob, where a user is afforded the ability to control the operation of the deadbolt knob from the interior of the dwelling, regardless if others have key access. The device comprises a hook-shaped assembly that is positioned under a conventional doorknob, whereby the device bears thereagainst while connected to a deadbolt knob. The device bears against the door knob as the deadbolt knob is attempted to be turned, thus preventing the deadbolt from being disengaged. The device improves the integrity a deadbolt lock, prevents others from gaining access to a dwelling, and reduces the chance of burglaries and home invasions in residential areas. The device, along with physical security, also provides an electronic monitoring means thereon to alert those inside the dwelling if the knob is being turned or if an unauthorized user is tampering with the device.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A deadbolt knob security device, comprising:

an elongated, intermediate member assembly having an upper end and a base end;

said upper end comprising a deadbolt knob attachment head having a housing adapted to surround a deadbolt knob, wherein said housing comprises an open interior, a forward aperture adapted to accept the deadbolt knob, and a rear portion pivotably connected to said intermediate member assembly;

wherein said housing further comprises an engagement slot on one side of the forward aperture and two corresponding slots on an opposing side of the forward aperture;

a retainer clip comprising a U-shaped planar surface configured to be slidably positioned through the engagement slot and the two corresponding slots transversely relative to the forward aperture, wherein said retainer clip is configured to be positioned between the deadbolt knob and a door surface when the deadbolt knob is positioned within the housing;

said base end comprising a door knob attachment member comprising a substantially U-shaped member;

said elongated, intermediate member assembly having length adjustability;

said deadbolt knob attachment head attached to said intermediate member assembly by a pivotable connection, the pivotable connection configured to permit uniaxial movement of the deadbolt knob attachment head;

said deadbolt knob attachment head adapted to impart rotation of a deadbolt knob onto said intermediate member assembly and said door knob attachment member adapted to bear against a door element to prevent rotation of said intermediate member.

2. The device of claim 1, further comprising:

an electronic monitoring means attachable to said intermediate member assembly;

said electronic monitoring means adapted to monitor motion of said intermediate member assembly and provide an audible warning when motion is detected.

3. The device of claim 1, wherein the pivotable connection further comprises a non-slip pivot joint.

4. The device of claim 1, wherein said intermediate member assembly further comprises:

an upper intermediate member and a lower intermediate member threadably connected to an elongated shank having a first and second threaded and tapped end;

said elongated shank threaded ends having opposite thread directions.

5. The device of claim 1, wherein said intermediate member assembly further comprises:

an upper intermediate member and a lower intermediate member;

said upper intermediate member fastened to a first threaded member extendable therefrom;

said lower intermediate member fastened to a second threaded member extendable therefrom;

said first and second threaded member each being threadably connected to an elongated shank having a first and second threaded and tapped end;

said elongated shank threaded ends having opposite thread directions.

6. The device of claim 1, wherein said intermediate member assembly further comprises:

an upper intermediate member slidably adjustable from within a lower intermediate member in a telescoping fashion;

said upper intermediate member being secured to said lower intermediate member using a set screw.

7. The device of claim 1, wherein said intermediate member assembly further comprises:

a sliding sleeve having a first and second elongated channel member in slidable engagement with one another;

said channel members having an elongated slot and said members being aligned via a lip extending from said first member;

a fastener adapted to clamp said sliding members together through said aligned elongated slots of said channel members.

8. The device of claim 1, wherein said intermediate member assembly further comprises:

an upper and lower intermediate member;

said upper intermediate member having a gear rack thereon;

said lower intermediate member having a pinion gear thereon in engagement with said gear rack of said upper intermediate member;

an adjustment member handle for controlling said pinion gear rotation.

9. The device of claim 1, wherein:

said intermediate member assembly further comprises an upper frame and a lower frame adjustably connected by a first and second intermediate member;

said upper and lower frame having an open, lattice-style construction;

a threaded shank having a first and second threaded and tapped end;

said threaded shank ends having opposite thread directions;

said first and second threaded intermediate member threadably connected to said threaded shank at its ends;

said door knob attachment member comprising a U-shaped portion of said lower frame;

said deadbolt knob attachment head pivotably attached to said upper frame.

10. The device of claim 9, further comprising:

a first and second dowel slidably engaged between said upper and lower frame.

11. The device of claim 9, further comprising:

a threaded aperture through said upper frame adapted to secure another intermediate member therein.

12. The device of claim 1, further comprising:

a door knob stem engaging member having a rounded construction comprising an exterior, rounded surface and a flat interior surface;

said interior and exterior surfaces being grooved;

said door knob stem engaging member adapted to support said door knob attachment member around a door knob stem.

13. The device of claim 1, wherein when the device is secured in place, the deadbolt knob attachment head is engaged with a deadbolt knob and the curved portion of the U-shaped member extends around a bottom of a door knob stem.

* * * * *